US006386921B1

(12) United States Patent
Casari

(10) Patent No.: US 6,386,921 B1
(45) Date of Patent: May 14, 2002

(54) AC OFFSET PLUG ADAPTOR

(76) Inventor: Derek Casari, 15477 Dickens St., Sherman Oaks, CA (US) 91403-3009

( * ) Notice: Subject to any disclaimer, the term of this patent is extended or adjusted under 35 U.S.C. 154(b) by 0 days.

(21) Appl. No.: 09/492,683

(22) Filed: Jan. 27, 2000

(51) Int. Cl.[7] ..... H01R 33/94
(52) U.S. Cl. ..... 439/651; 439/651; D13/139.8
(58) Field of Search ..... 439/490, 651, 439/105, 652

(56) References Cited

U.S. PATENT DOCUMENTS 2,597,600 A * 5/1952 Shapiro ..... 439/651
4,293,172 A * 10/1981 Lingaraju ..... 439/105
5,791,921 A * 8/1998 Lee ..... 439/651

* cited by examiner

*Primary Examiner*—Renee Luebke
*Assistant Examiner*—Briggitte R. Hammond

(57) ABSTRACT

An AC offset plug adaptor being rectangular in shape and having standard male prongs on the far end of the bottom surface of the said rectangular shape and a standard female receptacle on the opposite far end of the top of said rectangular shape, said male prongs being connected to said female receptacle by means of internal wiring.

2 Claims, 6 Drawing Sheets

AC OFFSET PLUG ADAPTOR

BACKGROUND OF THE INVENTION

This invention relates generally to the field of electrical plug adaptors, and more particularly to an AC offset plug adaptor.

AC adaptors of many kinds are available today in the market place. These include two prong to three prong adaptors, multiple socket adaptors, plug securing adaptors and the like.

Many of todays electric tools, appliances, toys and the like are powered by DC electric voltage that can be generated by an AC to DC transformer. The transformer is housed in a rectangular or square housing. A common configuration has the prongs that fit into a standard AC wall outlet molded into the rectangular housing so that they protrude from the housing thereby enabling the user to plug the transformer directly into a wall socket or extension cord of power strip socket. These transformers are commonly called wall pack transformers because they plug directly into the wall. Unfortunately, the size of the wall pack transformer housing is generally large enough to block the adjacent socket whether it be in a wall socket or on an extension strip having multiple sockets. This blockage makes for an inefficient use of the wall socket or extension strip in that adjacent sockets are obstructed. In cases where multiple wall pack transformers are plugged in next to each other or where the wall pack transformer is exceptionally large, there can be as much as a fifty percent loss of available sockets.

SUMMARY OF THE INVENTION

The primary object of the invention is to provide a means to plug in an AC to DC wall pack transformer into a standard AC extension strip or wall outlet so that it does not interfere with the adjacent sockets on the strip or outlet.

Other objects and advantages of the present invention will become apparent from the following descriptions, taken in connection with the accompanying drawings, wherein, by way of illustration and example, an embodiment of the present invention is disclosed.

AC offset plug adaptor being rectangular in shape and having standard male prongs on the far end of the bottom surface of said rectangular shape and a standard female on the opposite far end of the top of said rectangular shape, said male prongs being connected to said female by means of internal wiring.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
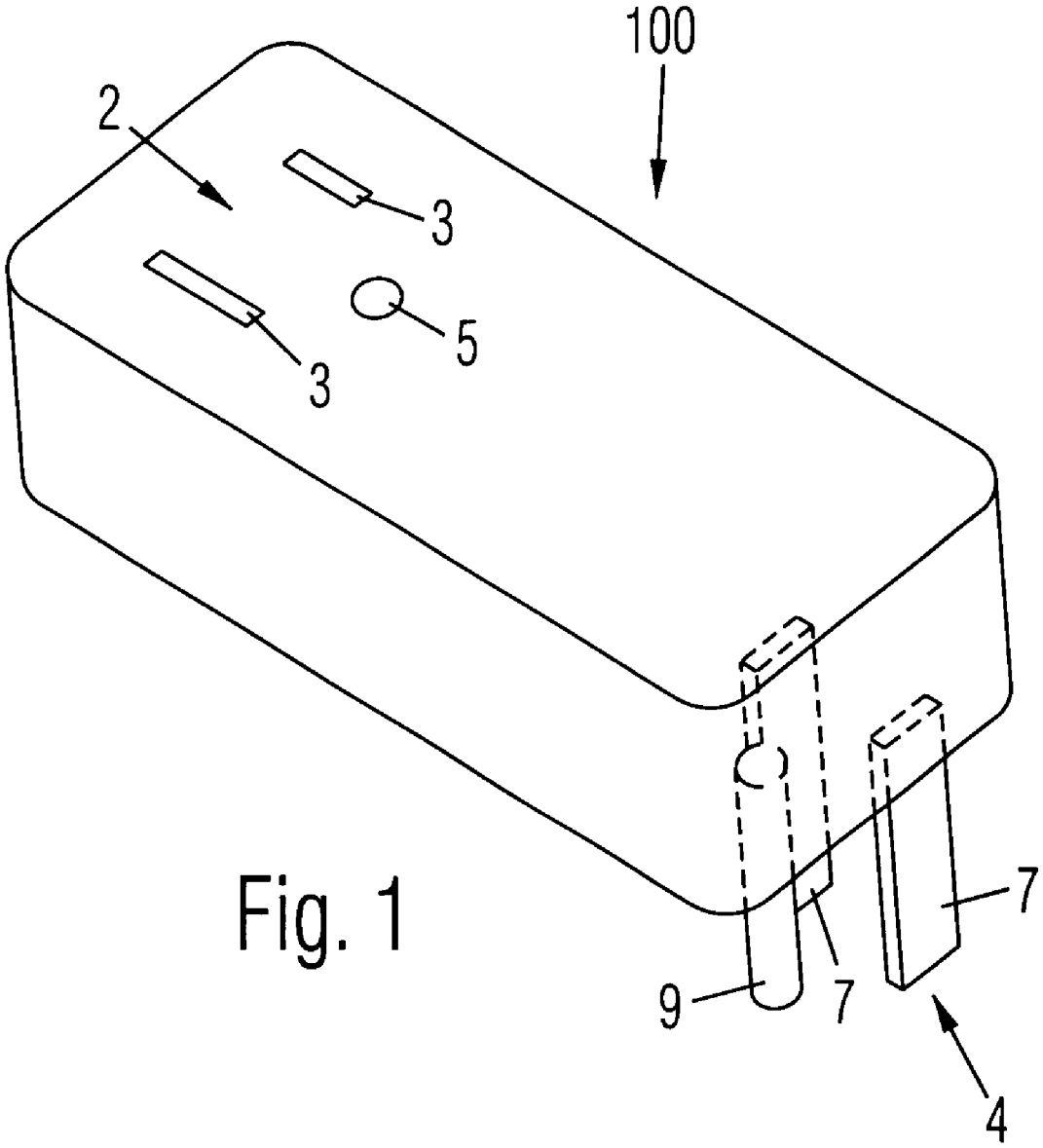
FIG. 1 is a perspective view of the AC adaptor of the present invention
Figure 2:
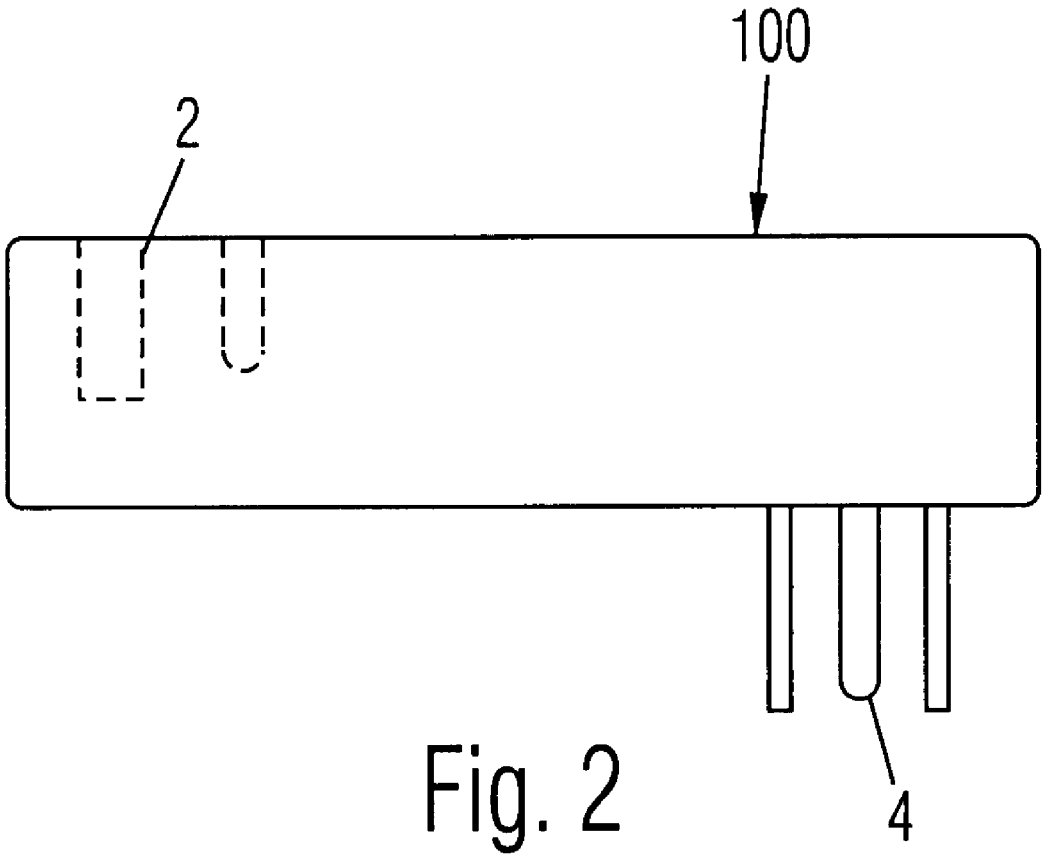
FIG. 2 is a side view of the AC adaptor of the present invention.
Figure 3:
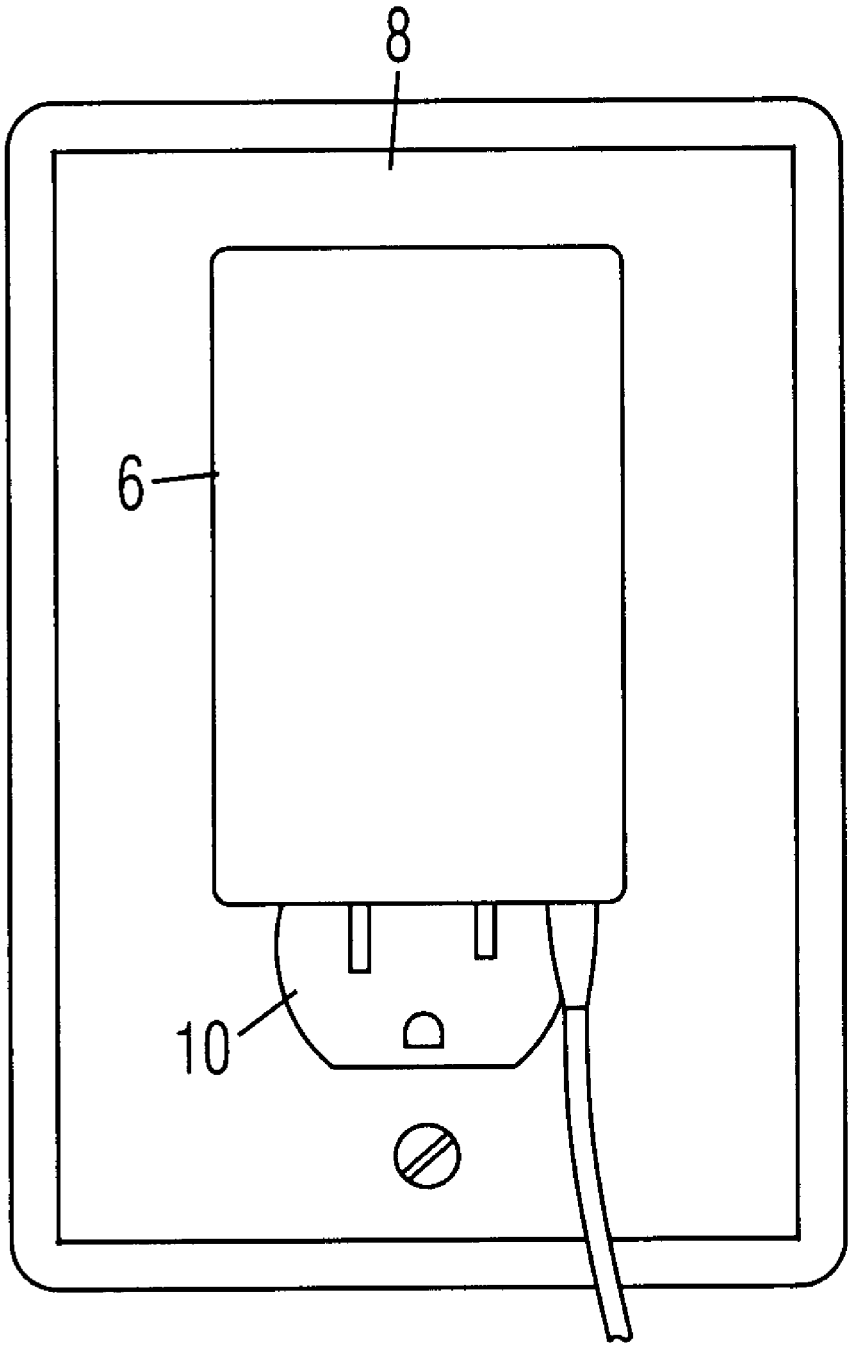
Fig. 3 Prior Art
FIG. 3 is a front view of a wall pack transformer plugged into a wall socket
Figure 4:
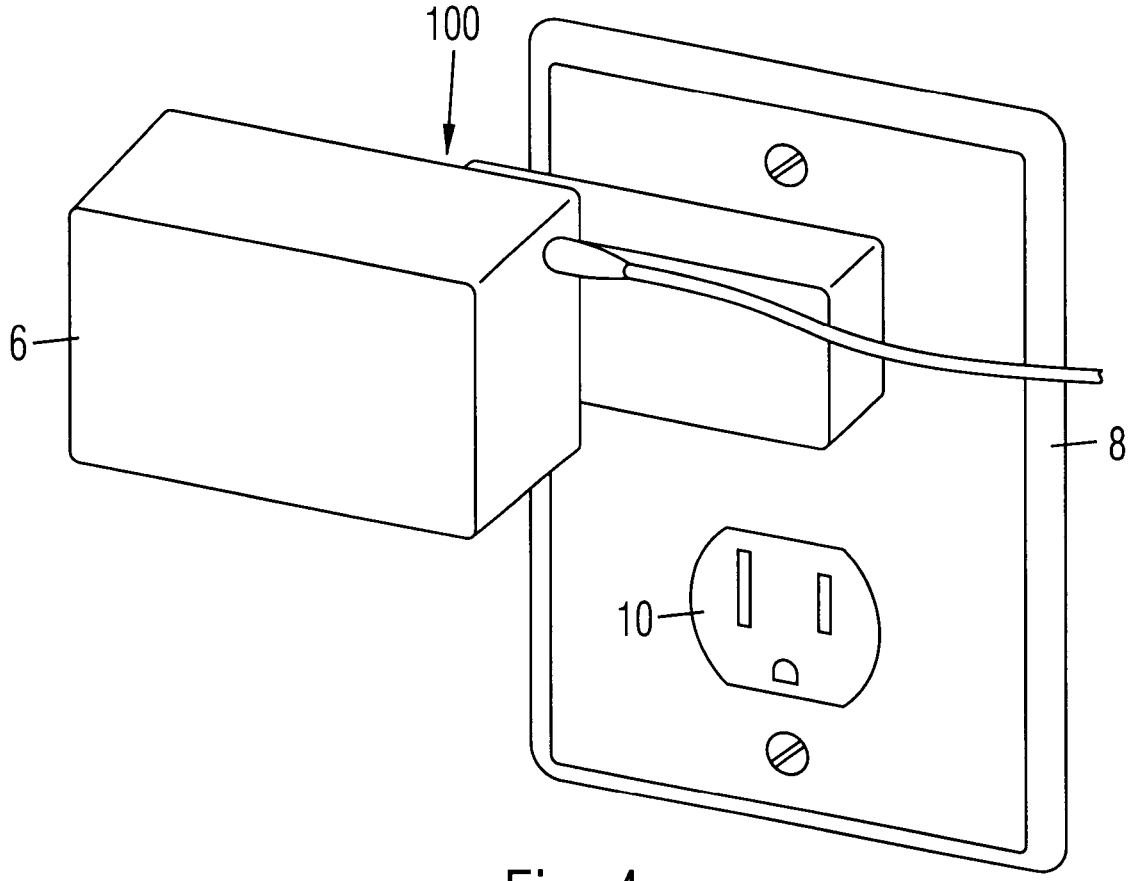
FIG. 4 is a perspective view of a wall pack transformer plugged into an extension strip
Figure 5:
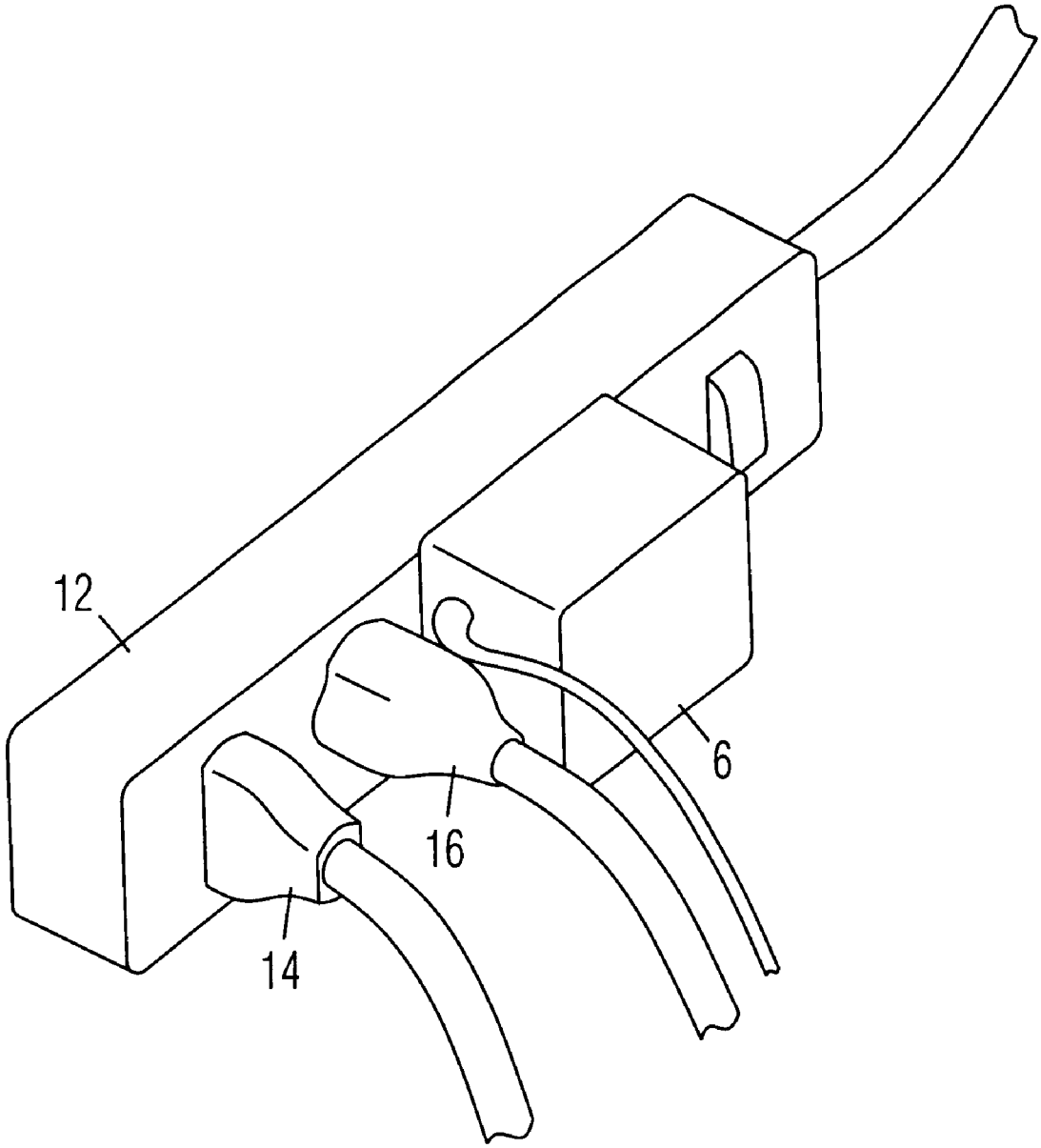
Fig. 5 Prior Art
FIG. 5 is a perspective view of a wall pack transformer plugged into the present invention and the present invention plugged into a wall socket
Figure 6:
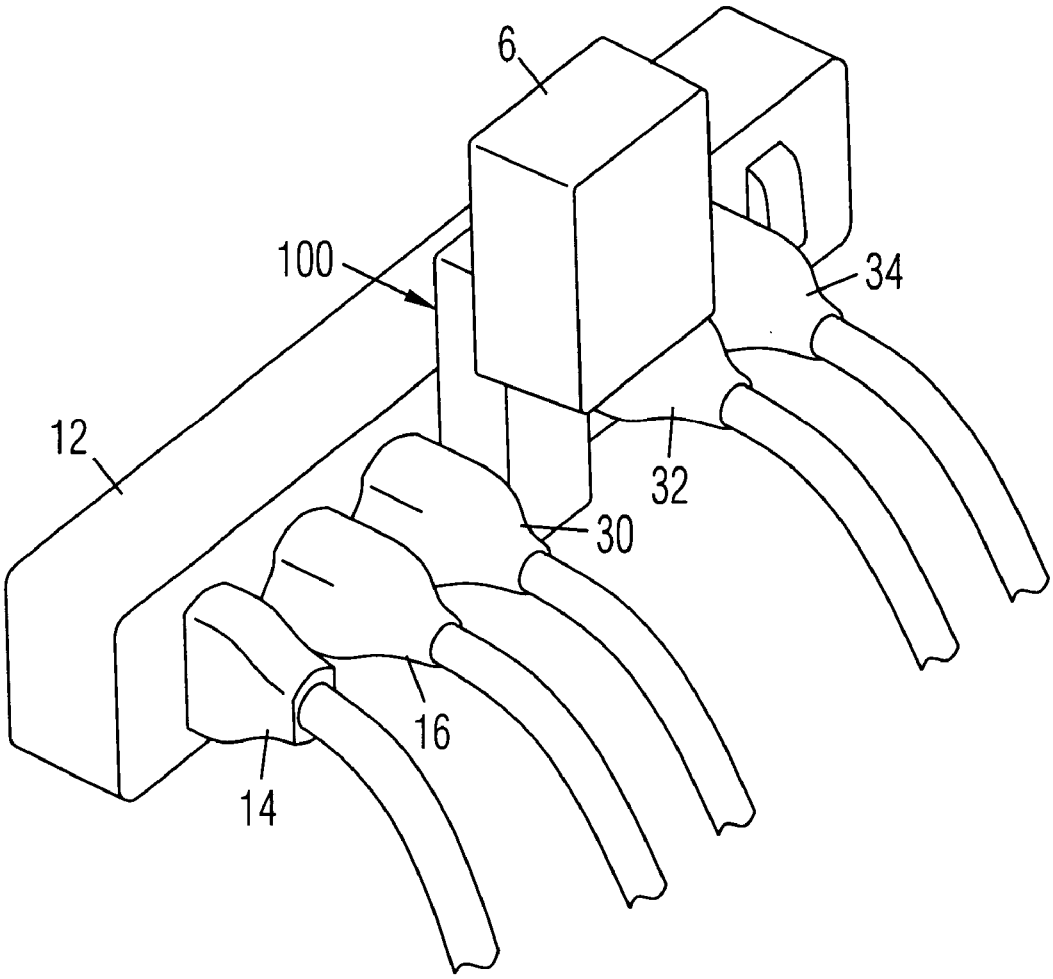
FIG. 6 is a perspective view of a wall pack transformer plugged into the present invention and the the present invention plugged into an extension strip.

Referring now to FIG. 1 we see the AC offset adaptor of the present invention 100 where the AC female receptacle 2 is located on the far left top surface of the rectangular adaptor housing 6 and the male AC plug portion 4 is located on the right side of the lower surface of the adaptor housing. Female receptacle 2 is comprised of two elongated slots 3 and a generally circular hole 5 in a triangular arrangement. Elongated slots 3 are distributed along a transverse direction of rectangular housing 6. Male plug portion 4 is comprised of two flat prongs 7 and a generally cylindrical prong 9 in a triangular arrangement. Flat prongs 7 are distributed along a longitudinal direction of rectangular housing 6. Referring to FIG. 2 we see a side view of the adaptor 100 of the present invention showing the female receptacle 2 in dotted lines and the male plug 4. FIG. 5 shows a view of a standard wall socket 8 where an AC to DC wall pack transformer 6 is plugged into the top receptacle and the bottom receptacle 10 is partially blocked by the wall pack transformer 6 causing the lower receptacle 10 to be inoperable. FIG. 4 shows the same standard wall socket 8 where the adaptor 100 of the present invention is in place and plugged into the top receptacle of the wall socket 8 and the AC to DC wall pack transformer 6 is plugged into the adaptor 100. Notice that the lower receptacle 10 is now fully available to be used for plugging in an additional AC appliance or the like. FIG. 5 shows a perspective view of an AC power strip 12 that is commonly used to plug in a plurality of AC powered devices. AC wall pack adaptor 6 is plugged into the center of the strip 12 and covers three sockets that therefore become inoperable with regard to the plugging in of additional AC appliances. FIG. 6 shows a perspective view of the same power strip 12 where adaptor 100 is in place and wall pack transformer 6 is plugged into it. Notice that the neighboring sockets become available for use so that AC plugs 30, 32 and 34 can be plugged into strip 12 as well as plugs 14 and 16 which were originally plugged in. In the above described and illustrated way, a the present invention can help a person obtain more efficient use of an AC wall outlet or AC power strip by offsetting a wall pack transformer to the left or right of the outlet or strip thereby uncovering otherwise obstructed AC sockets.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An AC offset plug adapter, comprising:

a rectangular housing;

a female receptacle on a top side of a first end of said housing;

a male plug portion on a bottom side of a second end of said housing substantially offset from said female receptacle, said male plug portion comprising two flat prongs distributed along a longitudinal direction of said rectangular housing;

wherein said male plug portion is adapted to be plugged into a conventional AC receptacle on an AC wall plate, said housing is adapted to extend horizontally away from said AC wall plate to avoid blocking any adjacent AC receptacle, said male plug is also adapted to be plugged into another AC receptacle on an AC power strip and to extend orthogonally away from said power strip to avoid blocking other AC receptacles on said power strip.

2. An AC offset plug adapter, comprising:

a rectangular housing;

a female receptacle on a top side of a first end of said housing, said female receptacle comprising two elongated slots distributed along a transverse direction of said rectangular housing;

a male plug portion on a bottom side of a second end of said housing substantially offset from said female receptacle, said male plug portion comprising two flat prongs distributed along a longitudinal direction of said rectangular housing, so that said prongs and said slots are distributed along substantially different directions to each other;

wherein said male plug portion is adapted to be plugged into a conventional AC receptacle on an AC wall plate, said housing is adapted to extend horizontally away from said AC wall plate to avoid blocking any adjacent AC receptacle, said male plug is also adapted to be plugged into another AC receptacle on an AC power strip and to extend orthogonally away from said power strip to avoid blocking any other AC receptacles on said power strip;

wherein said slots of said female receptacle are arranged so that said longitudinal direction of said rectangular housing is adapted to be aligned with a longitudinal direction of a conventional AC wall pack transformer plugged into said female receptacle, so that said wall pack transformer is oriented to be positioned between any adjacent AC plugs when said housing is plugged into said AC power strip.

* * * * *